US007790639B2

(12) United States Patent
Davenport et al.

(10) Patent No.: US 7,790,639 B2
(45) Date of Patent: Sep. 7, 2010

(54) BLOWABLE INSULATION CLUSTERS MADE OF NATURAL MATERIAL

(75) Inventors: Francis L. Davenport, Ballston Lake, NY (US); Joseph Rumiesz, Voorheesville, NY (US)

(73) Assignee: Albany International Corp., Albany, NY (US)

( * ) Notice: Subject to any disclaimer, the term of this patent is extended or adjusted under 35 U.S.C. 154(b) by 277 days.

(21) Appl. No.: 11/317,360

(22) Filed: Dec. 23, 2005

(65) Prior Publication Data

US 2007/0148426 A1 Jun. 28, 2007

(51) Int. Cl.
*D04H 1/00* (2006.01)

(52) U.S. Cl. ..... 442/327; 428/360; 428/361; 428/378; 428/221

(58) Field of Classification Search ..... 428/221, 428/360, 378, 361, 375; 442/327
See application file for complete search history.

(56) References Cited

U.S. PATENT DOCUMENTS

| | | | |
|---|---|---|---|
| 1,714,240 | A | 5/1929 | Rayner |
| 2,314,482 | A | 3/1943 | De Fries |
| 2,339,431 | A | 1/1944 | Slayter |
| 2,713,547 | A | 7/1955 | Frederick |
| 2,926,980 | A | 2/1960 | Steinruck |
| 2,958,919 | A | 11/1960 | Palmer |
| 3,046,173 | A | 7/1962 | Copeland |
| 3,373,455 | A | 3/1968 | Kaplan |
| 3,423,795 | A | 1/1969 | Watson |
| 3,461,026 | A | 8/1969 | Schick |
| 3,511,747 | A | 5/1970 | Davies |
| 3,589,956 | A | 6/1971 | Krantz et al. |
| 3,654,055 | A | 4/1972 | Gray |
| 3,702,260 | A | 11/1972 | Jayne et al. |
| RE27,587 | E | 2/1973 | Paliyenko et al. |
| 3,733,245 | A | 5/1973 | Veazey et al. |
| 3,772,137 | A | 11/1973 | Tolliver |
| 3,828,934 | A | 8/1974 | Green et al. |
| 3,892,909 | A | 7/1975 | Miller |
| 3,923,942 | A | 12/1975 | Nishiumi et al. |
| 4,040,371 | A | 8/1977 | Cooper et al. |
| 4,065,599 | A | 12/1977 | Nishiumi et al. |
| 4,118,531 | A | 10/1978 | Hauser |
| 4,129,675 | A | 12/1978 | Scott |
| 4,144,294 | A | 3/1979 | Werthaiseeer et al. |
| 4,164,534 | A | 8/1979 | Orgino |
| 4,167,604 | A | 9/1979 | Aldrich |
| 4,248,927 | A | 2/1981 | Liebman |
| 4,259,400 | A | 3/1981 | Bolliand |
| 4,293,604 | A | 10/1981 | Campbell |
| 4,304,817 | A | 12/1981 | Frankosky |
| 4,364,996 | A | 12/1982 | Sugiyama |
| 4,400,426 | A | 8/1983 | Aldrich |
| 4,401,610 | A | 8/1983 | Ohberg |
| 4,413,030 | A | 11/1983 | Tesch et al. |
| 4,418,103 | A | 11/1983 | Tani et al. |
| 4,468,336 | A | 8/1984 | Smith |
| 4,477,515 | A | 10/1984 | Masuda et al. |
| 4,481,256 | A | 11/1984 | Masuda et al. |
| 4,540,625 | A | 9/1985 | Sherwood |
| 4,551,378 | A | 11/1985 | Carey, Jr. |
| 4,555,421 | A | 11/1985 | Yasue |
| 4,588,635 | A | 5/1986 | Donovan |
| 4,618,531 | A | 10/1986 | Marcus |
| 4,681,789 | A | 7/1987 | Donovan et al. |
| 4,783,364 | A | 11/1988 | Ilan |
| 4,794,038 | A | 12/1988 | Marcus |
| 4,814,229 | A | 3/1989 | Tesch |
| 4,818,599 | A | 4/1989 | Marcus |
| 4,820,574 | A | 4/1989 | Tesch |
| 4,886,693 | A | 12/1989 | Haranoya et al. |
| 4,911,980 | A | 3/1990 | Tesch |
| 4,917,943 | A | 4/1990 | Tesch |
| 4,921,645 | A | 5/1990 | Insley |
| 4,940,502 | A | 7/1990 | Marcus |
| 4,992,327 | A | 2/1991 | Donovan et al. |
| 4,998,309 | A | 3/1991 | Tesch |
| 5,023,131 | A | 6/1991 | Kwok |
| 5,041,104 | A | 8/1991 | Seal |
| 5,043,207 | A | 8/1991 | Donovan et al. |
| 5,057,168 | A | 10/1991 | Muncrief |
| 5,064,689 | A | 11/1991 | Young, Sr. et al. |
| 5,080,964 | A | 1/1992 | Tesch |
| 5,082,711 | A | 1/1992 | Goerens |
| 5,112,684 | A | 5/1992 | Halm et al. |
| 5,123,949 | A | 6/1992 | Thiessen |
| 5,169,580 | A | 12/1992 | Marcus |
| 5,218,740 | A | 6/1993 | Synder et al. |
| 5,238,612 | A | 8/1993 | Halm et al. |
| 5,286,556 | A | 2/1994 | Tesch |
| 5,294,392 | A | 3/1994 | Marcus |

(Continued)

FOREIGN PATENT DOCUMENTS

| | | | |
|---|---|---|---|
| GB | 2 065 7285 | A | 7/1981 |

(Continued)

*Primary Examiner*—N. Edwards
(74) *Attorney, Agent, or Firm*—Frommer Lawrence & Haug LLP; Ronald R. Santucci

(57) ABSTRACT

A blowable insulation material comprising random shaped blowable clusters which are comprised of natural fibers or material. In preferred embodiments, the clusters also comprise man-made fibers or materials. A process to produce the blowable clusters is also disclosed.

10 Claims, No Drawings

U.S. PATENT DOCUMENTS

| | | | |
|---|---|---|---|
| 5,298,320 | A | 3/1994 | Geoffrey |
| 5,329,868 | A | 7/1994 | Tesch |
| 5,338,500 | A | 8/1994 | Halm et al. |
| 5,344,707 | A | 9/1994 | Snyder |
| 5,458,971 | A | 10/1995 | Hernandez et al. |
| 5,491,186 | A | 2/1996 | Kean et al. |
| 5,492,580 | A | 2/1996 | Frank |
| 5,500,295 | A | 3/1996 | Halm et al. |
| 5,516,580 | A | 5/1996 | Frenette et al. |
| 5,589,536 | A | 12/1996 | Golino et al. |
| 5,620,541 | A | 4/1997 | Herzberg |
| 5,624,742 | A | 4/1997 | Babbitt et al. |
| 5,659,911 | A | 8/1997 | Kirkbride et al. |
| 5,683,811 | A | 11/1997 | Hernandez et al. |
| 5,719,228 | A | 2/1998 | Taylor et al. |
| 5,851,665 | A | 12/1998 | Marcus |
| 6,053,999 | A | 4/2000 | Marcus |
| 6,077,883 | A | 6/2000 | Taylor et al. |
| 6,232,249 | B1 | 5/2001 | Kawada |
| 6,329,051 | B1 | 12/2001 | Groh et al. |
| 6,329,052 | B1 | 12/2001 | Groh et al. |
| 6,589,652 | B2 | 7/2003 | Groh et al. |
| 6,613,431 | B1 | 9/2003 | Rumiesz et al. |

FOREIGN PATENT DOCUMENTS

| | | |
|---|---|---|
| WO | WO 89/04886 | 6/1989 |
| WO | WO 96/10665 | 4/1996 |
| WO | WO 00/65139 | 11/2000 |
| WO | WO 00/77287 | 12/2000 |
| WO | WO 03/072865 | 9/2003 |
| WO | WO 2004/020724 | 3/2004 |

BLOWABLE INSULATION CLUSTERS MADE OF NATURAL MATERIAL

FIELD OF THE INVENTION

The invention relates to down-like insulating clusters and a method for manufacturing the same.

BACKGROUND OF THE INVENTION

There have been many attempts to achieve an insulating material having down-like qualities for use in insulating articles such as clothing, sleeping bags, comforters, and the like. Prior efforts to develop a feasible material have most often yielded those that are too heavy and dense to be considered down-like.

An exception to this is for example, U.S. Pat. No. 4,588,635 to Donovan which discloses a superior synthetic down and has particular reference to light-weight thermal insulation systems which can be achieved by the use of fine fibers in low density assemblies and describes a range of fiber mixtures, that, when used to fabricate an insulating batt, provides advantageous, down-like qualities such as a high warmth-to-weight ratio, a soft hand, and good compression recovery. This material approaches, and in some cases might even exceed the thermal insulating properties of natural down. From a mechanical standpoint, however extremely fine fibers suffer from deficiencies of rigidity and strength that make them difficult to produce, manipulate and use. Recovery properties of such a synthetic insulator material are enhanced by larger fiber diameters, but an increase in the large fiber component will seriously reduce the thermal insulating properties overall. The problems associated with mechanical stability of fine fiber assemblies are exacerbated in the wet condition since surface tension forces associated with the presence of capillary water are considerably greater than those due to gravitational forces or other normal use loading and they have a much more deleterious effect on the structure. However, unlike waterfowl down, the disclosed fiber combination described provides excellent resistance to wetting.

Another exception is U.S. Pat. No. 4,992,327 to Donovan et al. which discloses the use of binder fiber components to improve insulator integrity without compromising desired attributes. More specifically the invention disclosed therein relates to synthetic fiber thermal insulator material in the form of a cohesive fiber structure, which structure comprises an assemblage of: (a) from 70 to 95 weight percent of synthetic polymeric microfibers having a diameter of from 3 to 12 microns; and (b) from 5 to 30 weight percent of synthetic polymeric macrofibers having a diameter of 12 to 50 microns, characterized in that at least some of the fibers are bonded at their contact points, the bonding being such that the density of the resultant structure is within the range 3 to 16 kg/m$^3$, the thermal insulating properties of the bonded assemblage being equal to or not substantially less than the thermal insulating properties of a comparable unbonded assemblage. The reference also describes a down-like cluster form of the preferred fiber blends. The distinct performance advantages of the cluster form over the batt form are also disclosed in the patent.

However, these prior art clusters often were generally hand fabricated in a slow, tedious, batch process. Furthermore, the prior art materials were not easily blowable materials which could be used with conventional manufacturing equipment. Therefore there was a need for a blowable material which may be used as a partial or full replacement for down which may be manufactured and blown using conventional equipment.

In part as a result of this need, there was developed blowable insulation clusters as described in U.S. Pat. No. 6,329,051. The '651 patent described blowable clusters made from shredded bonded batt or bonded web. The web or batt was described as the same fiber blend described in the '327 patent to Donovan. By shredding the batt or web formed of the materials described in the '327 patent the clusters were found to achieve down-like qualities including loft and insulating properties. Such clusters, in an admixture with natural material, is described in U.S. Pat. No. 6,329,052. Note, the disclosure of the aforementioned patents are incorporated fully herein by reference.

However, the blowable insulation clusters of the '051 and '052 patents incorporate only synthetic fibers. In contrast, the present invention is directed to provide blowable insulation clusters being made of natural man-made materials or natural in combination with man-made materials.

SUMMARY OF THE INVENTION

It is an object of the invention to provide a blowable insulation material for use as a partial or a complete replacement for down.

One embodiment of the present invention is a blowable insulation material including one or more of the materials such as batt, web, bonded batt, bonded web, a portion of bonded batt, and a portion of bonded web shredded one or more times into random shaped blowable clusters which are formed from a mixture of natural fibers or material or in combination with man-made fibers or materials. In another preferred embodiment, the clusters comprise water repellant or lubricant finished fiber and/or dry fiber and/or binder fiber mixed therewith. A process to produce the blowable clusters is also disclosed.

The various features of novelty which characterize the invention are pointed out in particularity in the claims annexed to and forming a part of this disclosure. For a better understanding of the invention, its operating advantages and specific objects attained by its uses, reference is made to the accompanying descriptive matter in which preferred embodiments of the invention are illustrated.

Thus by the present invention, its objects and advantages will be realized, the description of which should be taken in conjunction with the following detailed description.

DETAILED DESCRIPTION OF THE INVENTION

In one embodiment of the present invention, the invention comprises clusters made from natural fibers or materials alone or in combination with man-made fibers or material. The starting material may be such a material in the form of a batt or web etc. as aforesaid, or other form suitable for the purposes and may or may not be a heatset. For certain applications, the batt or web may contain water repellant finished or lubricant finished fiber and/or dry fiber and/or binder fiber. The batt or web is then mechanically shredded one or more times into small clusters which are blowable and have desired down-like qualities. It is generally contemplated that a web (generally a single layer material) and batt (generally a multi-layer material), or portions thereof may be used to make the inventive clusters.

Natural fibers or material considered to be within the scope of the present invention include but are not limited to wool, cotton, flax, animal hair, silk, down as well as other natural fibers or materials.

The fiber clusters may be made with a light-weight card sliver made with a suitable fiber material or blend. When incorporating man-made fibers with natural fibers or material in a single batt, the fiber-blend of the man-made fibers is preferably the fiber-blend disclosed in U.S. Pat. No. 4,992,327 to Donovan et al. As aforesaid, this patent discloses an insulation material where macrofibers may be bonded together to form a support structure for microfibers. Bonding may also be between both macrofibers and some of the microfibers at their various contact points. Preferably however, when utilized, bonding is between macrofibers of the man-made fibers at their contact points. This provides a supporting structure which contributes significantly to the mechanical properties of the insulation material. Also, the fiber structure of the man-made component of the batt generally comprises from 70 to 95 weight percent of synthetic polymeric microfibers having a diameter of from 3 to 12 microns and from 5 to 30 weight percent of synthetic polymeric macrofibers having a diameter of 12 to 50 microns. Other preferred embodiments utilize fiber-blends comprising water repellant finished or lubricant finished fiber and/or dry fiber and/or binder fiber.

Typically, a sliver is first collected at the output side of a card and passes, when necessary or desired, directly through heated tubes that would thermally bond a binder fiber mixture if one were used. It is important that any bonding step employed is completed without shrinking and densifying the lofty card sliver. Each sliver-end falls through a vertical tube, while centered by guide rings, as heated air blows upward through the tube, bonding the lofty, linear, fiber assembly. Upon exit from the heated tube, the sliver is drawn to the entry side of a guillotine-type staple fiber cutter. A clean cut, without the densifying effects of fiber fusion at the cut, is achieved. This method results in a collection of very lofty fiber clusters.

A preferred method uses batt consisting of plied card-laps, although other fibrous forms may be equally suitable. Note, however, that care should be taken if conventional carding is used in situations where both natural and man-made material is involved, that such carding does not separate out, for example, the natural material e.g. down feathers from the web. Also, the card-laps or webs, are preferably formed into batt with densities comparable to the densities characteristic of down. The card-laps or webs may also be prepared from binder fiber and/or dry fiber (i.e. no lubricant/antistatic) and/or water repellant fibers of 0.5-6.0 denier. In a preferred method, the card-laps or webs comprise binder fiber, dry fiber, and water repellant fiber. These fibers may be a combination of natural and man-made fibers and materials as described above. These selected fibers may be preferably carded as long as undesired separation does not occur. Assembly by means of a single cylinder metallic card with stationary flats is possible. The output of the card may be sent through electric and/or gas fired sources of heat to heatset the binder fiber, when preparing a batt of natural and man-made fibers, for example. The batt is heated for a time and temperature sufficient to cause the fiber to bond, for example, between 300-400° F. After heat setting, or if a non-heat set batt or web is used, after formation the batt is then shredded, preferably two times in a blender to form the blowable clusters.

A variety of other variable factors may be modified to obtain desired effects on the blowable clusters, these include:

1. Increasing staple length up to the cardable limit to improve integrity and durability of the clusters;
2. Changing binder fiber content to "fine-tune" shreddability, cuttability, cohesiveness, and the performance characteristics of the clusters;
3. Varying the size, shape and aspect ratios of the clusters;
4. Using ultrasonic bonding means if suitable for purpose;
5. Shredding the clusters more than once;
6. Shredding only portions of batt or web.

Those of skill in the art will appreciate that other factors may also have effects on the blowable clusters and can be optimized for their desired purpose without exceeding the scope of the instant invention.

It has been observed that the twice shredded clusters are typically smoother and more easily blendable than clusters which are shredded only once. Further it is possible to take strips or sliver of heatset batt which may have been slitted, and then take these portions through a standard shredding process to form clusters.

The invention further contemplates utilizing man-made fiber blends or a mixture of natural and man-made fiber blends that are not discussed above. These blend ranges limit average fiber diameter to ensure a high level of insulating performance. In some instances, an average fiber diameter greater than that defined by the cited patents may be desirable. For example, relatively large diameter fibers may be utilized if the end product is a pillow or upholstery and compressional stiffness is an important requirement.

Also depending upon application, it may be desirable to blend the so formed clusters in an admixture with other clusters made of different natural and/or man-made materials or with natural and/or man-made fibers or material depending upon the desired result being sought.

Thus by the present invention its advantages will be realized and although preferred embodiments have been disclosed and described in detail herein, its scope should not be limited thereby rather its scope should be determined by that of the appended claims.

What is claimed is:

1. A blowable insulation material comprising one or more of the materials taken from the group consisting of bonded batt, bonded web, a portion of bonded batt, and a portion of bonded web wherein the bonded batt, bonded web, portion of bonded batt, and portion of bonded web are comprised of natural fibers or material, shredded one or more times into random shaped blowable clusters.

2. The blowable insulation material of claim 1, wherein the blowable clusters also comprise man-made fibers or material.

3. The blowable insulation material of claim 1, wherein the bonded batt, bonded web, a portion of bonded batt, and a portion of bonded web comprises only natural fibers or materials.

4. The blowable insulation material of claim 1, wherein the bonded batt, bonded web, a portion of bonded batt, and a portion of bonded web comprises a combination of man-made and natural fibers or materials.

5. The blowable insulation material of claim 2, wherein the bonded batt, bonded web, a portion of bonded batt, and a portion of bonded web is heat set.

6. The blowable insulation material of claim 5, wherein the blowable clusters comprise random fibers that are bonded together at a plurality of contact points.

7. The blowable insulation material of claim 6, wherein man-made fibers comprise from 70 to 95 weight percent of synthetic polymeric microfibers having a diameter of from 3 to 12 microns and from 5 to 30 weight percent of synthetic polymeric macrofibers having a diameter of 12 to 50 microns.

8. The blowable insulation material of claim 1 wherein the bonded batt, bonded web, a portion of bonded batt, and a portion of bonded web shredded batt comprises one or more of the materials from the group consisting of 0.5-6.0 denier water repellant or lubricant finished fiber, dry fiber, and binder fiber.

9. The blowable insulation material of claim 1 in an admixture with one or more of the following: natural material and man-made material.

10. The blowable insulation material of claim 2 in an admixture with one or more of the following: natural material and man-made material.

* * * * *